United States Patent [19]

Hama et al.

[11] Patent Number: 4,850,921

[45] Date of Patent: Jul. 25, 1989

[54] FULL AUTOMATIC TOTAL INSPECTION SYSTEM FOR IMPLOSION-PROTECTED CATHODE-RAY TUBE

[75] Inventors: Yasuo Hama; Shigetake Takaku; Hirosi Murai, all of Mobara, Japan

[73] Assignee: Hitachi, Ltd., Tokyo, Japan

[21] Appl. No.: 937,391

[22] Filed: Dec. 3, 1986

[51] Int. Cl.[4] ..... H01J 9/42

[52] U.S. Cl. ..... 445/63

[58] Field of Search ..... 73/865.9, 862.06, 643; 445/3, 4, 8, 63, 64, 63; 269/908; 358/245, 246

[56] References Cited

U.S. PATENT DOCUMENTS

| | | | |
|---|---|---|---|
| 1,955,794 | 4/1934 | Du Mont et al. | 445/63 |
| 3,004,649 | 10/1961 | Waltke et al. | 445/63 |
| 3,340,358 | 9/1967 | De Gier et al. | 358/245 |
| 3,369,201 | 2/1968 | Fiore et al. | 445/3 |
| 3,961,241 | 6/1976 | Goldstein et al. | 324/404 |
| 3,978,713 | 9/1976 | Penney | 73/643 |
| 4,080,836 | 3/1978 | Thompson et al. | 73/643 |
| 4,179,778 | 12/1979 | Corson | 445/8 |
| 4,522,071 | 6/1985 | Thompson | 73/643 |
| 4,573,934 | 3/1986 | Strouse | 445/3 |
| 4,641,196 | 2/1987 | Musha et al. | 358/245 |
| 4,643,027 | 2/1987 | Deutsch et al. | 73/865.8 |

FOREIGN PATENT DOCUMENTS

| | | | |
|---|---|---|---|
| 0123613 | 10/1984 | European Pat. Off. | 445/3 |
| 0031760 | 3/1977 | Japan | 445/3 |
| 0140450 | 10/1979 | Japan | 445/3 |

OTHER PUBLICATIONS

Translation of Kuribayashi et al., JA 0140456.

*Primary Examiner*—Michael J. Tokar
*Assistant Examiner*—Robert R. Raevis
*Attorney, Agent, or Firm*—Antonelli, Terry & Wands

[57] ABSTRACT

An automatic total inspection system for an implosion-protected cathode-ray tube which measures and inspects the total members of a product by simultaneous and nondestructive tests on some or all items selected from among the thickness of a panel, the positional accuracy and the tension of a tension band for implosion-protection, the positional accuracy and the diameter of a nugget of weld at the welded part of the tension band, and the presence or absence of mounting lugs and a reinforcement plate and the positional accuracy thereof. The adoption of this system enables the inspection process to be carried out without man-power, thereby preventing any error which may be caused by the fatigue of operators, resulting in total inspection with high reliability.

5 Claims, 3 Drawing Sheets

FULL AUTOMATIC TOTAL INSPECTION SYSTEM FOR IMPLOSION-PROTECTED CATHODE-RAY TUBE

BACKGROUND OF THE INVENTION

The present invention relates to a full automatic total inspection system suitable for assuring the total members of an implosion-protected cathode-ray tube by measuring and inspecting the performance of implosion-protection of the total members of the product by a nondestructive test.

Most of the cathode-ray tubes which are now in practical use are provided with implosion-protecting means.

FIG. 2 is a side elevational view of an implosion-protected cathode-ray tube. The reference numeral 1 represents a tension band for implosion-protection, 2 a welded part (nugget of weld) of a welded end of the tension band, 3 a reinforcement plate inserted between the tension band and a bulb, 4 a mounting lug, and 5 a glass panel all.

Although the mounting lug does not necessarily have a direct relation to the performance of implosion-protection (nevertheless, whether the mounting lugs are at the right positions or not are important to the user), the positional accuracy and the tension of the tension band for implosionprotection, the positional accuracy and the diameter of the nugget of weld of the welded part of the band, whether or not the mounting lug and the reinforcement plate are mounted and the positional accuracy thereof, and the thickness of the glass panel all have relations to the performance of implosionprotection of a cathode ray tube. However, because the measurement of these items by measuring apparatus is difficult, generally manually they are and visually inspected and some of them are statistically examined by sampling destructive tests.

That is, since an appropriate measuring method (e.g., a method for nondestructive measurement of the tension of a tension band for implosion-protection) has not been developed, or in consideration of the cost and the like of the measuring apparatus and controlling apparatus, a known impact test has conventionally been carried out as a test for assuring and confirming the safety to a person (the performance of implosion-protection). Since this is a kind of a destructive test, it is not adaptable to all the members of a product, and a process of statistically assuring all the members of the product in the population by the results of a test on a typical sample which is extracted from a population and the results of a substitutional character assurance test for assuring the performance of implosion-protection (implosion-protection performance test) on the sample has been adopted. However, as the requirements of general customers for the quality, and the safety of a product increases, the assurance system which depends upon sampling tests in the statistic method has become unsatisfactory.

One of the known tests of this kind is disclosed in Japanese Patent Application Laid-Open No. 191933/1982.

SUMMARY OF THE INVENTION

Accordingly, it is an object of the present invention to eliminate the above-described problems in the prior art and to provide an automatic total inspection system for inspecting the implosion-protection characteristics of all the members of a produced implosion-protected cathode-ray tube.

To achieve this aim, the present invention has developed an automatic system which inspects the total members of a produced implosion-protected cathode ray tube by nondestructive tests on a plurality of items selected from among the thickness of the panel, the positional accuracy and the tension of a tension band for implosion-protection, the positional accuracy and the diameter of the nugget of weld of the welded part of a tension band, whether or not the mounting lugs and the reinforcement plate are mounted and the positional accuracy thereof, or by nondestructive tests on all these items.

This is enabled because the development of ultrasonic measuring methods and apparatus facilitates the measurement of the tension of the tension band for implosion-protection and the thickness of the panel glass by a nondestructive test, thereby enabling the total inspection of all the above-described items, and because the ratio of the performance to the cost of the measuring and controlling apparatus has generally been so increased that a full automatic total inspection system is economically efficient.

The present inventor has already completed a full automatic total inspecting machine for each of the above-described items and put it to practical use. In the present invention, the above-described inspecting machines are combined into a system, because it has been confirmed that since the inspecting machines are automatic, they dispense with man-power, so that no error is generated due to the fatigue of the operators, and total measurement and inspection is enabled with high reliability.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1A:
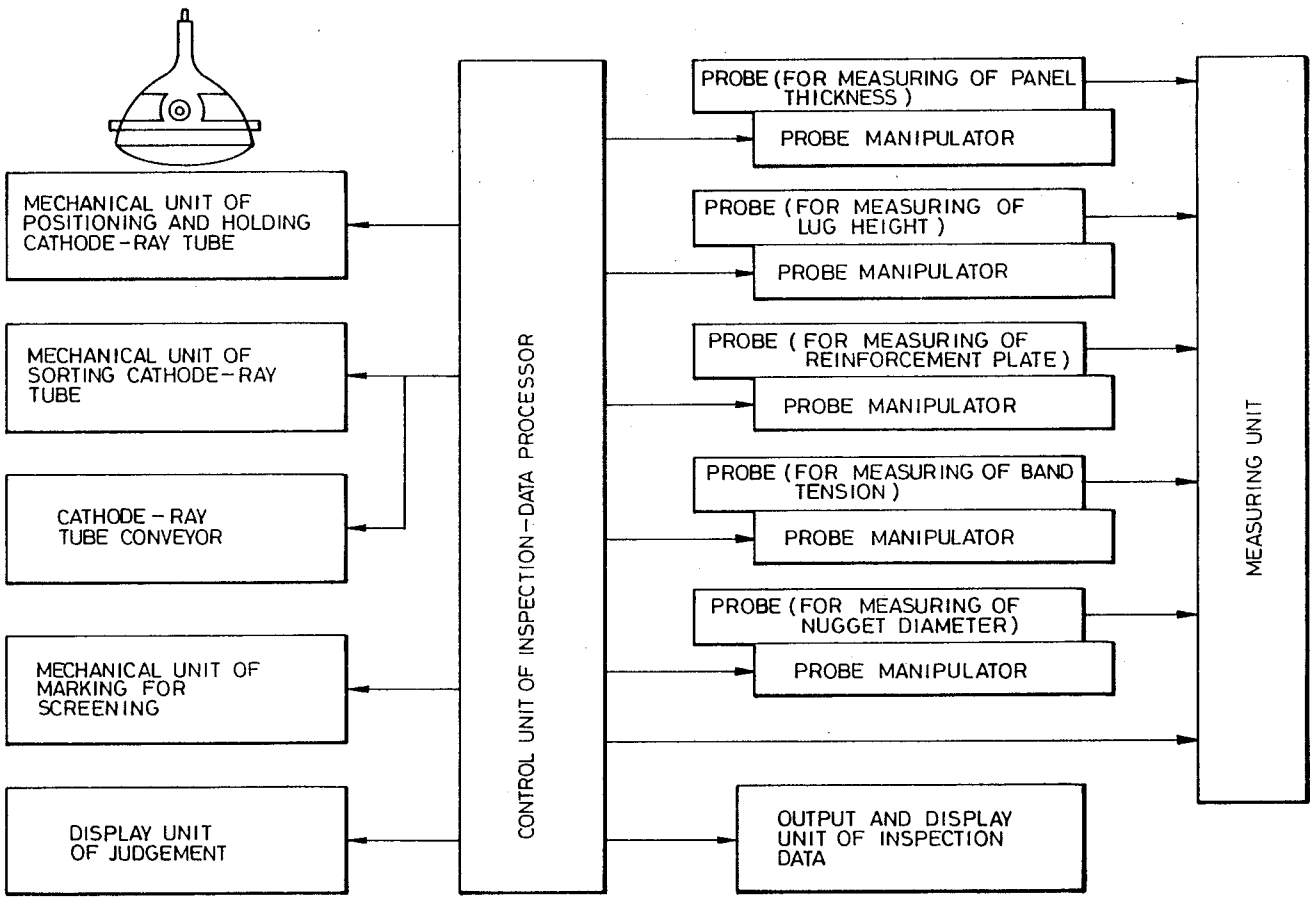
FIG. 1*a* shows the structure of an embodiment of a system according to the present invention.

Referring first to FIG. 1*a*, an embodiment of a system according to the present invention is shown. In this system, the type of the cathode-ray tube which is being carried on a conveyor is first specified by a known mechanical unit of sorting cathode-ray tube (on the basis of, for example, a mark, pasted label, etc. on the glass panel skirt or the like). The cathode-ray tube is then positioned on the conveyor at the relatively correct position with respect to various measuring and inspecting apparatus and the probes thereof by a mechanical unit of positioning and holding cathode-ray tube. In this state, the presence or absence of a tension band for implosion-protection, the positional accuracy thereof, the tension of band tightening, the presence or absence of the nuggets of weld of the welded ends of the tension band, the number, the position and the diameter thereof, the presence or absence of the reinforcement plate, the positional accuracy thereof, the presence or absence of mounting lugs, the position, the thickness of glass panel, etc. are measured or inspected by respective measuring and inspecting apparatus simultaneously and in a short time. When the presence or absence of the metal members, and the mounting positions thereof are inspected, the probes are manipulated at respective predetermined positions or in the vicinity thereof mainly to measure the presence or absence of electric conduction and the magnitude of electric resistance. The tension of band tightening and the thickness of the panel glass, etc. are measured using an ultrasonic measuring method. Except for the measurement of the tension, the measuring apparatus may be partially replaced by optical means depending upon the measuring accuracy, the cost, etc. in the system. The total system is controlled by a control unit of inspection-data processor, and the probe manipulating mechanisms used for measuring the respective inspection items are also controlled thereby. The measurement data and the inspection data on the respective items are input to a measuring unit and whether or not the results are accepted or rejected is judged and displayed on a judgement display unit. The control unit of inspection-data processor displays the results which have been input to the measuring unit on an output and display unit of inspection-data. These resulting data are printed by a mechanical unit of marking for screening to make a table showing each number of the products and of their respective inspection resulting data, or the results are printed on the respective labels which are thereafter corresponding pasted on respective products.

Figure 1B:
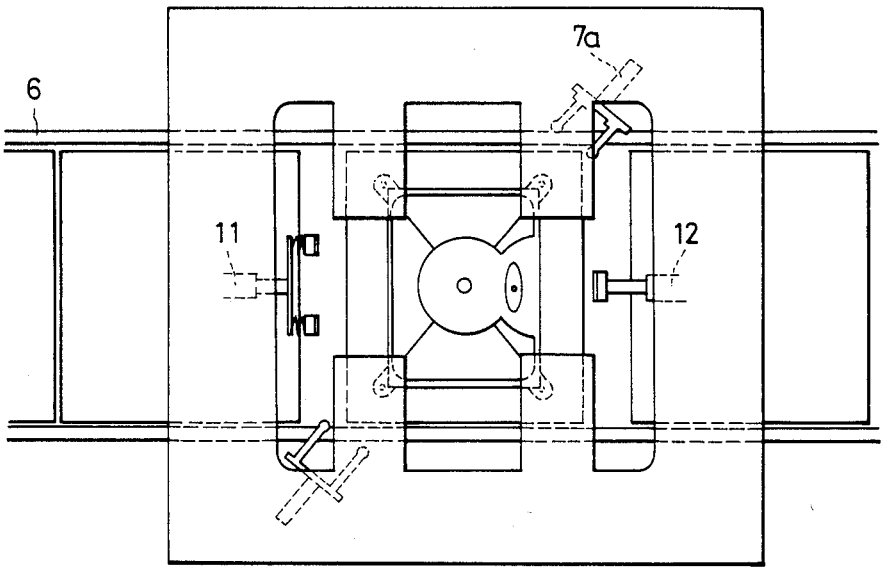
FIG. 1*b* is a plan view of a mechanism for positioning a cathode-ray tube to be inspected at the relatively correct position with respective to various measuring and inspecting apparatus and the probes thereof.

FIG. 1*b* is a plan view of a cathode-ray tube to be inspected in the state of being brought to a positioning and holding mechanism by a conveyor, as described above. The reference numeral 6 denotes a conveyor for a cathode ray tube, *7a* a mechanical unit of positioning and holding which positions a cathode ray tube at the correct position in the plane with respect to various measuring apparatus and the probes thereof, 11 a probe mechanism for measuring the tension of band tightening, and 12 a probe mechanism for measuring the diameter of a nugget of weld. After the cathode-ray tube has reached the positioning and holding mechanism, the cathode-ray tube is positioned at the relatively correct position with respect to various measuring and inspecting apparatus and the probes thereof.

Figure 1C:
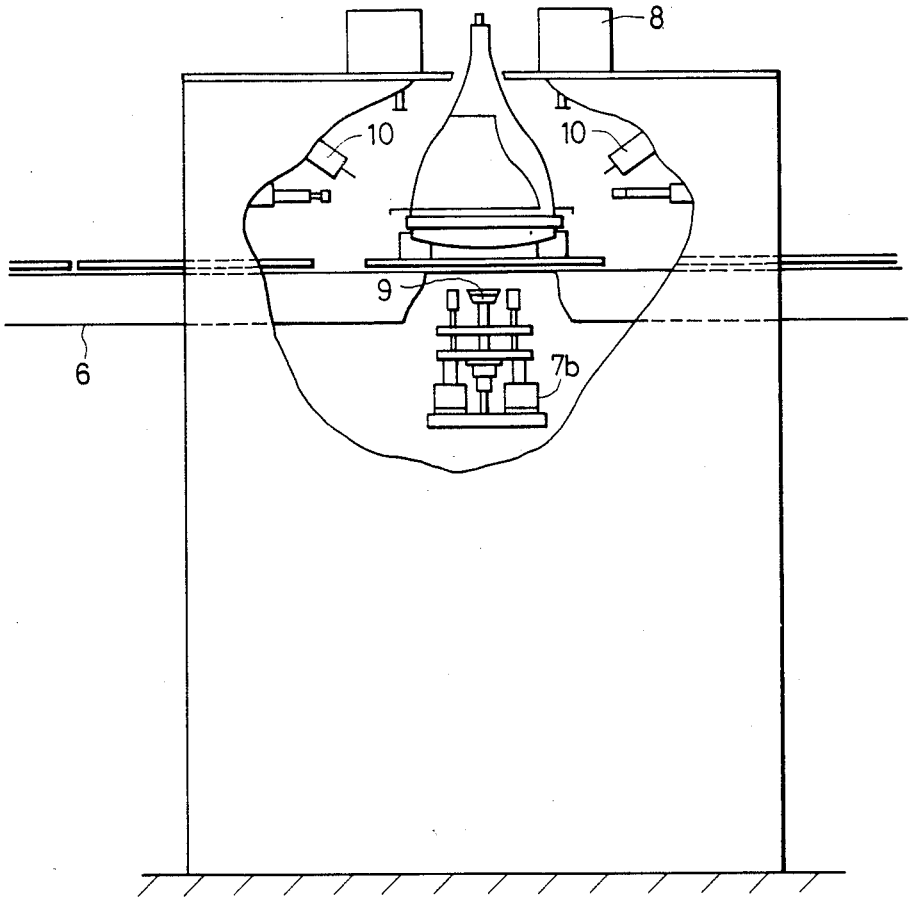
FIG. 1*c* is a side elevational view of a mechanism for vertically positioning a cathode-ray tube to be inspected at the relatively right position with respective to various measuring and inspecting apparatus and the probes thereof.
Figure 2:
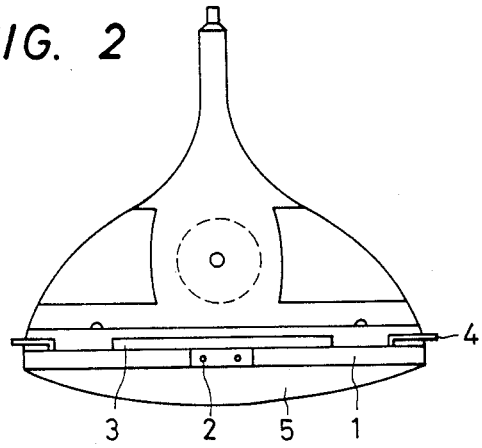
FIG. 2 is a side elevational view of an implosion-protected cathode ray tube.

FIG. 1*c* is a side elevational view of the cathode-ray tube to be inspected in the state of being brought to the positioning and holding mechanism by the conveyor. The reference numeral 6 denotes the conveyor, *7b* a mechanical unit of positioning and holding which vertically positions various measuring apparatus and the probes thereof with respect to the cathode ray tube, 8 a probe mechanism for measuring the height of a lug, 9 a probe mechanism for measuring the thickness of a glass panel and 10 a probe mechanism for detecting the position of a reinforcement plate.

The system according to the present invention is installed in the process for implosion-protection of a cathode ray tube, and the performance of implosion-protection is measured and inspected in the line, so that only good products in terms of implosion-protection are fed to the next process, the defective products being removed, and the products which are capable of being implosion-protected over again being returned to the implosion-protecting process.

Thus, in this system, the inspection items on the mechanical safety and reliability of a product are inspected by nondestructive tests, and the total inspection on these items is enabled, thereby greatly enhancing the reliability of the product.

As described above, according to the present invention, it is possible to inspect the inspection items on the safety and reliability of the mechanical strength of a cathode ray tube automatically and quickly . Not only the labor and material costs are reduced thereby, but also since the total inspection is enabled, it is possible to assure the mechanical safety and reliability of the total members of a product.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An automatic inspection system for inspecting an implosion-protected cathode-ray tube comprising:

support means for supporting said cathode-ray tube and for transporting said cathode-ray tube to a test position;

measuring and testing means for testing a plurality of elements of said cathode-ray tube, said measuring and testing means including, first means for nondestructively and automatically testing the thickness of a glass panel on said cathode-ray tube, second means for nondestructively and automatically testing the positional accuracy and tension of a tension band disposed on said cathode-ray tube for implosion-protection, third means for nondestructively and automatically testing the positional accuracy and the diameter of a weld spot on said tension band, and fourth means for nondestructively and automatically detecting the presence or absence and positional accuracy of mounting lugs and a reinforcement plate on said cathode-ray tube; and control means for controlling said measuring and testing means such that at least two of said plurality of elements of said cathode-ray tube are automatically and substantially simultaneously tested.

2. An automatic inspection system according to claim 1, wherein said first means includes an ultrasonic testing means for testing the thickness of said glass panel, said second means includes a probe means for testing the positional accuracy of said tension band and an ultrasonic testing means for testing the tension of said tension band, said third means includes a probe means for testing the positional accuracy and diameter of said weld spot, and said fourth means includes a probe means for detecting the presence or absence and positional accuracy of said mounting lugs and said reinforcement plate.

3. An automatic inspection system according to claim 1, wherein all of said plurality of elements of said cathode-ray tube are automatically and substantially simultaneously tested.

4. An automatic total inspection system for an implosion-protected cathode-ray tube comprising:

means for measuring and inspecting each of a plurality of cathode-ray tubes including means for simultaneously and automatically testing at least two of a plurality of items selected from the group consisting of the thickness of a glass panel, the positional accuracy and the tension of a tension band for implosion-protection, the positional accuracy and the diameter of a welded part of said tension band, the presence or absence of mounting lugs and a reinforcement plate, and the positional accuracy of said mounting lugs and said reinforcement plate, wherein said testing is performed using nondestructive tests, and wherein the presence or absence of said mounting lugs and said reinforcement plate, the positional accuracy of said mounting lugs, said reinforcement plate, said tension band and said welded part of said tension band and the diameter of at least said welded part of said tension band are measured and inspected by probes, and the tension of said tension band and the thickness of said panel are mounted using an ultrasonic means.

5. An automatic total inspection system for an implosion-protected cathode-ray tube comprising:

means for measuring and inspecting each of a plurality of a cathode-ray tubes including means for simultaneously and automatically testing a plurality of items consisting of the thickness of a glass panel, the positional accuracy and the tension of a tension band for implosion-protection, the positional accuracy and the diameter of a welded part of said tension band, the presence or absence of mounting lugs and a reinforcement plate, and the positional accuracy of said mounting lugs and said reinforcement plate, wherein said testing is performed using nondestructive tests.

* * * * *